United States Patent [19]

Biek

[11] Patent Number: 4,767,295

[45] Date of Patent: Aug. 30, 1988

[54] DEACTIVATING ROTOR VANE KICK-OUT MECHANISM

[75] Inventor: Paul A. Biek, Houston, Tex.

[73] Assignee: Dresser Industries, Inc., Dallas, Tex.

[21] Appl. No.: 83,512

[22] Filed: Aug. 7, 1987

[51] Int. Cl.[4] ..... F01C 1/344

[52] U.S. Cl. ..... 418/151; 418/266

[58] Field of Search ..... 418/151, 266, 223, 265

[56] References Cited

U.S. PATENT DOCUMENTS

| | | | |
|---|---|---|---|
| 29,473 | 8/1860 | Donovan | 418/151 |
| 818,399 | 4/1906 | Wright | 418/151 |
| 873,201 | 12/1907 | Augustine | 418/151 |
| 1,006,896 | 10/1911 | Augustine | 418/151 |
| 2,146,877 | 2/1939 | Appleton | 418/151 |
| 2,240,465 | 4/1941 | Sorge | 418/151 |
| 3,954,358 | 5/1976 | Normandin | 418/151 |
| 3,964,447 | 6/1976 | Normandin | 123/236 |
| 4,428,195 | 1/1984 | Linder et al. | 60/397 |

FOREIGN PATENT DOCUMENTS

| | | | |
|---|---|---|---|
| 16203 | 1/1982 | Japan | 418/151 |

*Primary Examiner*—John J. Vrablik

[57] ABSTRACT

The invention provides a radial vane motor with springs for forcing the vanes radially outward from the rotor. The rotor is eccentrically mounted within a cylindrical cavity in the motor. The vanes extend radially outward from radial slots in the rotor and contact the inner wall of the cavity. Each vane has a spring and a push rod for biasing the vane radially outward against the cylinder wall. Each spring is disposed in a spring chamber positioned diametrically opposite one of the radial slots. Each push rod includes a flyweight disposed within the spring chamber. The spring acts on the flyweight to urge the push rod against the vane during start up and slow speed operation of the motor. When the rotor is rotating at normal speed, centrifugal force acts to urge the vanes radially outward and to deactivate the springs by forcing the flyweight radially opposite the vanes to compress the springs. Thus, the springs are protected from continual flexing by the vanes as the rotor rotates.

10 Claims, 1 Drawing Sheet

DEACTIVATING ROTOR VANE KICK-OUT MECHANISM

TECHNICAL FIELD

The invention relates generally to a compressible fluid motor having radial vanes extending from a rotor and means for forcing the radial vanes out from the rotor. The forcing means are deactivated once the rotor is turning fast enough to generate a centrifugal force sufficient to urge the vanes out from the rotor without the additional force provided by the forcing means.

BACKGROUND OF THE INVENTION

Conventional compressible fluid motors include a rotor positioned within a cylindrical rotor cavity with the rotor having vanes arranged in radial slots in the rotor. These types of motors are commonly known as radial vane motors. The rotor is usually positioned eccentrically within the cavity, requiring the rotor vanes to move in and out of the rotor as it rotates. During the power portion of the rotation, the vanes are "kicked out" of their radial slots in order to expose a greater surface to the incoming pressurized fluid. As the vanes approach the end (or top) of the power stroke, the vanes contact the cylinder wall and are forced by the wall into their respective slots as the rotor rotates past the top of the stroke.

Various devices and methods are known in the art for kicking out the rotor vanes. A common method simply utilizes the incoming air pressure to urge the vanes out from the rotor. The pressurized air starts the rotor rotating, and once it is rotating it generates a centrifugal force that is sufficient to urge the vanes out of their slots. However, the air only method is slow in starting up the rotor and is unsatisfactory during periods of low pressure.

Another common method for extending the rotor vanes uses springs or spring devices that bias the vanes out toward the cylinder wall. These spring devices help to ensure good rotor start capabilities and continued operation under low air supply pressure. However, one of the problems with spring devices is the chronic fatigue failure of the spring mechanism. The spring mechanism is constantly flexing as the vanes move in and out of the rotor. The flexing continues even after the rotor is rotating fast enough to generate a centrifugal force sufficient to force the vanes out from the rotor without the assistance of the spring. This continual flexing causes fatigue failure of the spring mechanism, which can create problems in the operation of the motor. The spring may weaken or break due to the continued flexing, thereby severely limiting the start-up capabilities of the motor. Furthermore, a piece of a broken spring may lodge in the slot and prevent the radial vane from moving in and out of the slot as the rotor rotates, resulting in extended downtime for disassembly and repair of the motor. Thus, a need exists for a device that will kick-out the rotor vanes initially at start-up and under low air flow conditions and that will be deactivated when the rotor is rotating sufficiently to generate a centrifugal force to urge the vanes out from the rotor.

SUMMARY OF THE INVENTION

The present invention provides a means for forcing out radial vanes from a rotor during start-up and conditions of low air supply pressure. When the rotor is rotating fast enough that the forcing means are no longer necessary to force the vanes out from the rotor, the forcing means are deactivated. Deactivation of the forcing means saves them from fatigue failure caused by unnecessary continual flexing.

In one embodiment, the invention includes the combination of a rotor positioned within a rotor cavity, rotor vanes slidably engaged in radial slots in the rotor, forcing means engaged with the vanes for forcing the vanes radially outward from the rotor, and deactivating means engaged with the forcing means for deactivating the forcing means when the rotor is turning fast enough to generate a centrifugal force sufficient to force the vanes out from the rotor without the additional force provided by the forcing means.

In a preferred embodiment, the forcing means includes a push rod and a compression spring. The spring is positioned within the rotor in a spring chamber that is diametrically opposite a vane slot. The push rod is slidably engaged within a bore in the rotor extending from the spring chamber to the vane slot. The spring acts on the push rod to force the vane out from the rotor. The deactivating means includes a flyweight mounted on the push rod in such a manner that when the rotor rotates, the flyweight compresses the spring in the opposite direction from the vane and prevents the spring from flexing. In this manner, the springs are deactivated at rotor speeds where they are not required so as to prolong the life of the springs and avoid damage to the motor.

BRIEF DESCRIPTION OF THE DRAWINGS

The foregoing and additional objects and advantages of the invention will be more apparent when the following Detailed Description is read in conjunction with the accompanying Drawings, wherein like reference characters denote like parts in all views and wherein.

DETAILED DESCRIPTION

The present invention relates to a radial vane motor that includes means for forcing the radial vanes out from the rotor during start-up of the motor and during periods of low air supply pressure to the motor. The invention also includes means for deactivating the forcing means when the rotor is rotating fast enough to generate a centrifugal force sufficient to force the vanes out from the rotor without the aid of the forcing means.

Figure 1:
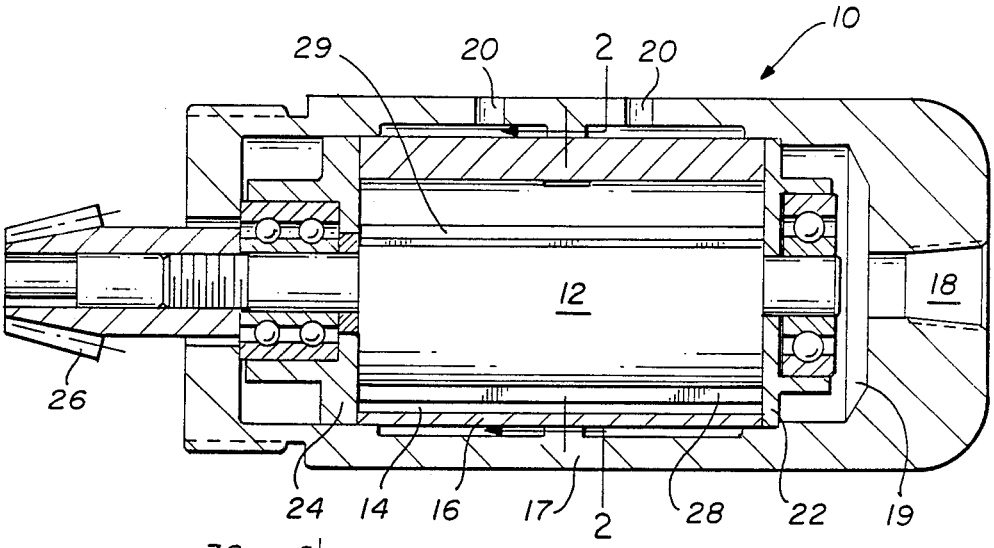
FIG. 1 is a cutaway view of a radial vane motor.

Referring to the Drawings, FIG. 1 shows a motor, generally indicated by the reference numeral 10, having a rotor 12 positioned within a rotor cavity 14 formed in a cylinder 16. The cylinder 16 is contained within a motor housing 17. FIG. 1 shows an air inlet 18 for admitting an incoming supply of pressurized air to the motor 10 from an external source (not shown). The air passes through inlet 18 to cavity 19 defined by housing 17, through a hole in a rear bearing plate 22 and into the rotor cavity 14. The pressurized air causes rotor 12 to rotate and the spent air is exhausted from rotor cavity 14 through exhaust ports 20. Also shown in FIG. 1 are a front bearing plate 24, a bevel pinion 26, and two radial vanes 28 and 29.

Figure 2:
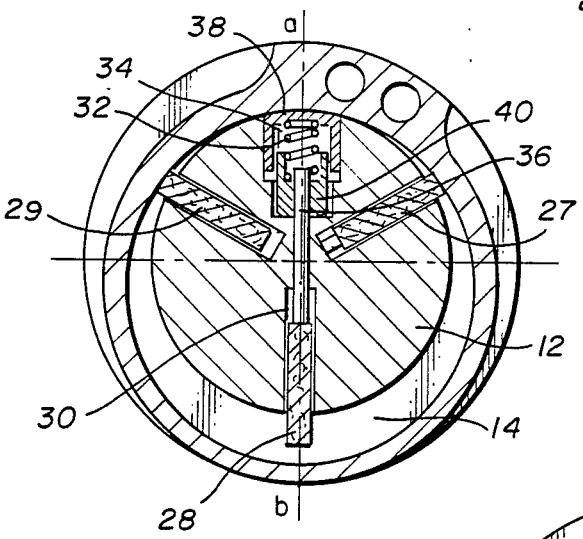
FIG. 2 is an enlarged cross-sectional view along line 2—2 in FIG. 1 showing the kick-out mechanism of the present invention with the rotor not rotating.
Figure 3:
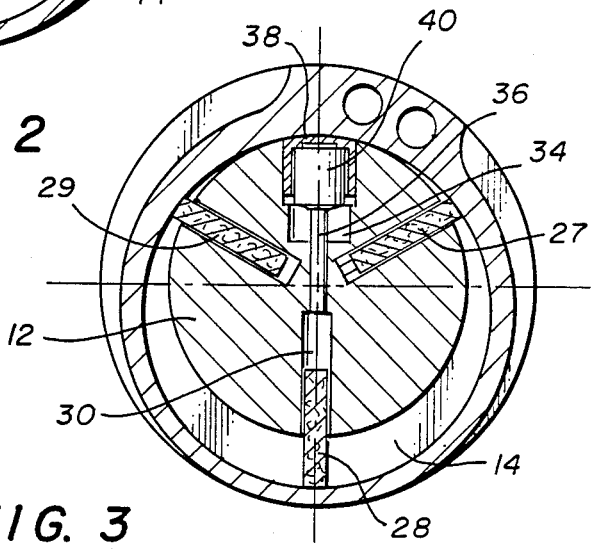
FIG. 3 shows the cross-sectional view of FIG. 2 with the rotor rotating sufficiently to deactivate the forcing means.

FIGS. 2 and 3 show a preferred embodiment of the invention. FIG. 2 is an enlarged cross-sectional view through line 2—2 in FIG. 1 showing the rotor in a position prior to the start of the motor. The rotor 12 is shown positioned eccentrically within the rotor cavity 14. Three radial vanes 27, 28, and 29 are shown, with each vane slidably engaged within a corresponding radial slot, such as the slot 30 for the vane 28. The vanes are of such length as to be able to fit wholly within their slots and to slide within the slots so that part of each vane can extend radially outward from the rotor 12.

FIG. 2 shows a spring 32 positioned in a spring chamber 34 within the rotor 12. The spring 32 is attached to a push rod 36 which extends through a bore in the rotor 12 and into the radial slot 30 diametrically opposite the chamber 34. The push rod 36 is slidably mounted in the rotor 12 such that it can move radially within the rotor 12. The spring 32 and the push rod 36 act as forcing means to force the vane 28 out from the slot 30 so that a portion of the vane 28 extends beyond the surface of the rotor 12. This extended portion acts to catch the flow of incoming pressurized air, which starts the rotor rotating.

The chamber 34 is enclosed by a spring cap 38 which seals off the chamber and keeps the spring 32 within the chamber 34. The spring cap 38 is mounted within the chamber 34, and the spring 32 is attached to the spring cap 38.

Also included within the chamber 34 is a flyweight 40 which is mounted on the push rod 36. Flyweight 40 may move within chamber 34 between the position shown in FIG. 2 and the position shown in FIG. 3. FIG. 3 shows the flyweight positioned as it would be with the rotor rotating at 25–100% of no load speed. Flyweight 40 is securely attached to rod 36, so as flyweight 40 moves within chamber 34, push rod 36 also slides within the rotor 12 and into or out of slot 30. In moving to the position shown in FIG. 3 from the position shown in FIG. 2, the flyweight 40 compresses spring 32 and prevents it from flexing. As the flyweight 40 compresses spring 32, the push rod 36 is withdrawn from the slot 30 and the radial vane 28 is no longer forced out from the rotor 12 by the action of the spring 32 and the push rod 36. In this manner, the flyweight 40 deactivates the spring 32 to prevent fatigue failure of the spring 32.

In operation of the motor 10, the spring 32 forces the rod 36 against the vane 28 so as to force the vane out from the rotor 12 as shown in FIG. 2. To start the motor, pressurized air is admitted to the inlet 18. As the vane 28 catches the flow of incoming pressurized air, the rotor starts to rotate. Due to the eccentrical positioning of the rotor 12 within the rotor cavity 14, the vanes 27, 28, and 29 contact the inner surface of the rotor cavity 14 as the vanes approach the top of the rotation. The vanes are forced toward the center of the rotor and are completely within the slots 30 as they pass the top of the rotation as indicated by letter "a" in FIG. 2. As the vanes move toward the bottom of the rotation, as indicated by letter "b", the spring 32 acts on push rod 36 to force the vane 28 out from the rotor so as to be able to catch the flow of air as shown in FIG. 2.

The springs are only needed during motor start-up or conditions of low supply pressure. During normal operation, the springs are deactivated in order to prolong their useful life. As the rotor 12 starts to rotate, the springs are not needed because the rotating rotor generates a centrifugal force that is directed away from the center of the rotor. The centrifugal force urges the vanes out from the rotor independently of the action of the springs. Typically, a speed of about 25% of the normal rotational speed is sufficient to kick the vanes out by centrifugal force.

In the preferred embodiment illustrated in FIGS. 2 and 3, the flyweight 40 acts to deactivate the spring 32. The centrifugal force generated by the rotating rotor forces the flyweight 40 out from the center of the rotor 12 and against the compressive force of the spring 32. As shown in FIG. 3, the rotor rotating at approximately 25–100% of no load speed generates sufficient force for the flyweight 40 to fully compress spring 32, and sufficient force to force the vanes 27–29 out to contact the inner wall of rotor cavity 14. Thus, the extended rotor vanes make the most efficient use of the supply air pressure.

The point at which the springs are deactivated depends on the weight of the flyweight 40 and the compressibility of spring 32. The deactivation point may be varied by changing either the flyweight or the spring or both.

FIGS. 2 and 3 show a forcing means comprising a spring 32 and a push rod 36, and a deactivating means comprising a flyweight 40 mounted on the push rod 36 acting on only one radial vane 28. Each of the three vanes 27–29, however, may be equipped with forcing and deactivating means. The forcing and deactivating means can be staggered along the length of the rotor 12 to avoid intersection of the rods in the middle. Alternatively, one forcing and deactivating means may be sufficient to aid the start-up of the rotor. However, if all three vanes 27–29 are equipped with the forcing means, start-up will be faster, and the motor 10 will operate more reliably during periods of low supply pressure.

From the foregoing Detailed Description, it is apparent that the invention provides forcing means for forcing out radial vanes and means for deactivating the forcing means once the rotor is rotating at a sufficient speed. Having described but one embodiment of the invention, it will be apparent to those skilled in the art that there may be changes and modifications made without departing from the spirit and scope of the invention as described.

I claim:

1. A radial vane motor, comprising:

a housing having a rotor cavity;

a rotor positioned within the rotor cavity, said rotor having a radial slot;

a vane slidably engaged in said slot;

forcing means operably and releasably engaged with said vane for forcing said vane radially outward from said rotor; and deactivating means engaged with said forcing means for disengaging said forcing means from the vane when said rotor is rotating and generating a centrifugal force sufficient to force said vane out from said rotor without the force provided by said forcing means.

2. The radial vane motor of claim 1, wherein said forcing means includes a spring and a push rod, said rotor further comprising a spring chamber and a borehole contained within the rotor, said spring positioned within said spring chamber and said push rod slidably engaged within said borehole, said borehole extending from said spring chamber to said radial slot, and said spring acting on said push rod to force said vane out from said rotor.

3. The radial vane motor of claim 2, wherein said deactivating means includes a flyweight mounted on said push rod and positioned at least partially within said spring chamber, said flyweight acting to compress said spring as said rotor rotates.

4. A radial vane motor, comprising:

a housing having a rotor cavity;

a rotor positioned eccentrically within said rotor cavity, said rotor having a plurality of radial slots;

a plurality of vanes, each of said vanes slidably disposed in one of said radial slots;

spring means releasably engaged with at least one of said vanes for forcing at least one of said vanes out from said rotor; and deactivating means engaged with said spring means for disengaging said spring means from the vane when the rotor is rotating and generating a centrifugal force sufficient to force said vanes out from the rotor.

5. The radial vane motor of claim 4, wherein said deactivating means includes a flyweight that compresses said spring means when said flyweight is acted upon by centrifugal force generated by the rotation of said rotor.

6. The radial vane motor of claim 4, further comprising a push rod positioned between said spring means and said at least one of said vanes such that said spring means acts on said push rod to force said at least one of said vanes out from said rotor.

7. The radial vane motor of claim 6, wherein said deactivating means includes a flyweight mounted on said push rod, said flyweight compressing said spring means when acted upon by centrifugal force.

8. A radial vane motor, comprising:

a motor housing having a rotor cavity;

a rotor positioned within the rotor cavity, said rotor having a radial slot and a spring chamber positioned diametrically opposite said radial slot;

a radial vane slidably disposed in said slot;

a push rod positioned diametrically between said spring chamber and said radial slot, spring means located in said spring chamber for forcing said push rod against said radial vane to force said vane out from said rotor; and a flyweight mounted on said push rod and positioned in said spring chamber to compress said spring means when said rotor is rotating and generating a centrifugal force sufficient to force said vane out from said rotor.

9. The radial vane motor of claim 8, wherein said rotor further comprises a borehole extending from said spring chamber to said radial slot, said push rod being slidably disposed within said borehole.

10. The radial vane motor of claim 8, further comprising a plurality of radial slots and a plurality of vanes, one of said vanes slidably disposed within each of said plurality of radial slots.

* * * * *